US011525213B2

(12) United States Patent
Koeckritz et al.

(10) Patent No.: US 11,525,213 B2
(45) Date of Patent: Dec. 13, 2022

(54) EDGE PROTECTOR FOR A PAPERMACHINE CLOTHING

(71) Applicant: VOITH PATENT GMBH, Heidenheim (DE)

(72) Inventors: Uwe Koeckritz, Heidenheim (DE); Jens Kallenberg, Herbrechtingen (DE)

(73) Assignee: VOITH PATENT GMBH, Heidenheim (DE)

( * ) Notice: Subject to any disclaimer, the term of this patent is extended or adjusted under 35 U.S.C. 154(b) by 0 days.

(21) Appl. No.: 17/420,552

(22) PCT Filed: Dec. 9, 2019

(86) PCT No.: PCT/EP2019/084203
§ 371 (c)(1),
(2) Date: Jul. 2, 2021

(87) PCT Pub. No.: WO2020/143967
PCT Pub. Date: Jul. 16, 2020

(65) Prior Publication Data

US 2022/0120037 A1 Apr. 21, 2022

(30) Foreign Application Priority Data

Jan. 8, 2019 (DE) ..... 102019100268.0

(51) Int. Cl.
*D21F 1/30* (2006.01)
*D21F 7/12* (2006.01)

(52) U.S. Cl.
CPC . *D21F 1/30* (2013.01); *D21F 7/12* (2013.01)

(58) Field of Classification Search
CPC ..... D21F 1/30; D21F 7/12; D21F 1/0027; D03D 1/0094; D03D 19/00; D03D 1/00; B65G 15/34; B65G 15/56; D21G 9/00
See application file for complete search history.

(56) References Cited

U.S. PATENT DOCUMENTS 5,316,132 A * 5/1994 Muraoka ..... B29C 63/003 198/847
5,731,059 A 3/1998 Smith et al.
(Continued)

FOREIGN PATENT DOCUMENTS

DE 4121572 C1 12/1992
DE 102007015055 A1 10/2008

*Primary Examiner* — Jacob T Minskey
*Assistant Examiner* — Matthew M Eslami
(74) *Attorney, Agent, or Firm* — Laurence A. Greenberg; Werner H. Stemer; Ralph E. Locher

(57) ABSTRACT

A method for producing an edge protector on a clothing for a machine producing or finishing a fibrous, paper, cardboard or tissue web, includes providing a clothing formed substantially from a woven fabric with crossing weft and warp threads and opposite side edges, applying a film strip onto a surface of one side edge and, immediately before bringing the film strip into contact with the clothing, surfaces of the film strip and the clothing facing each other are heated to slightly melt the surfaces. A pressing force exerted on the film strip applied to the surface of one of the side edges, results in the film strip penetrating at least partially into the woven fabric. That side edge of the clothing with the film strip is cooled, resulting in a stable, particularly integrally joined and form-locking connection between the film strip and the side edge of the clothing.

15 Claims, 2 Drawing Sheets

(56) References Cited

U.S. PATENT DOCUMENTS

| | | | | |
|---|---|---|---|---|
| 6,503,602 | B1 * | 1/2003 | Crosby | D21F 1/30<br>428/193 |
| 7,074,729 | B2 | 7/2006 | Leighton et al. | |
| 2010/0252217 | A1 | 10/2010 | Eberhardt et al. | |

* cited by examiner

EDGE PROTECTOR FOR A PAPERMACHINE CLOTHING

BACKGROUND OF THE INVENTION

Field of the Invention

The invention relates to a method for producing an edge protector on a clothing for a machine for producing or finishing a fibrous web, in particular a paper, board or tissue web, and to a clothing, in particular a dryer fabric, having an edge protector produced by this method.

To produce a fibrous web, such as a paper web, for example, a suspension of water and fibers is regularly applied to a forming fabric via a headbox in a paper machine. A major part of the water from the suspension is led away through the forming fabric, so that the actual fibrous web is formed. Further sections of the paper machine that follow the forming section regularly comprise further clothings, which are used for the further transport and the further drying of the fibrous web. As a rule, these are press felts and dryer fabrics. The various clothings are mostly formed here as woven materials, in which crossing weft and warp threads are connected or woven with one another. The woven materials can have a single layer or multiple layers. They can also have further layers, such as a staple fiber layer, for example to form a press felt. As a rule, the clothings are closed to form an endless belt and have two side edges, which can also be designated as side edges or longitudinal edges. During proper use, they circulate over diverse rolls in the paper machine at high speed. In order to guide the clothing safely here, use is made of guide elements, onto which the side edges of the clothings can run. However, the frictional forces produced as a result lead to a high loading of the side edges of the clothings. It is therefore usual to provide the latter with a protector in order to avoid premature wear.

Thus, it has previously been usual firstly to trim the woven clothing at the side edges in order to obtain a smooth edge, and then to fuse the mutually crossing threads in the edge region of the clothing to one another by means of a so-called "hot knife". After that, the edges are protected still further in that they are overmolded or adhesively bonded with an additional material, for example with silicone. As has transpired, however, in the known method, the edge protector does not always reliably fulfil expectations. In particular, in the past it occasionally occurred that threads extending parallel to the edge were pulled out of the woven material over their complete length in the region of the edge protector.

SUMMARY OF THE INVENTION

It is an object of the present invention to provide an alternative method for producing an edge protector which solves or at least reduces the aforementioned problems.

According to the invention, this object is achieved by the method described below. The subordinate claims relate to advantageous developments of the invention. According to the present invention, a method for producing an edge protector on a clothing for a machine for producing or finishing a fibrous web, in particular a paper, board or tissue web, is taught, which method comprises the following steps:

providing the clothing to be provided with the edge protector, wherein the clothing is substantially formed from a woven material with crossing weft threads and warp threads and has two side edges which lie opposite one another, applying a film strip to a surface of one of the two side edges of the clothing, wherein, immediately before the film strip comes into contact with the clothing, that surface of the film strip which faces the clothing and that surface of the clothing which faces the film strip are heated in such a way that the two melt slightly, exerting a pressing force on the film strip which has been applied to the surface of one of the two side edges of the clothing, with the result that the film strip penetrates at least partially into the woven material, and cooling that side edge of the clothing which is provided with the film strip, with the result that a stable, in particular integral and form-locking, connection is formed between the film strip and the side edge of the clothing.

Surprisingly, it has transpired that the edges of the clothing which have been protected according to the method according to the invention are less prone to wear in practice than the edges protected with the conventional method. This can presumably be explained in that, as a result of the slight melting of the woven material threads in the edge region of the clothing, on the one hand, and of the film strip, on the other hand, not only is a form-locking but additionally also an integral connection formed between the film strip and the woven material. This apparently leads to the connection being so firm and stable that even when a thread extending parallel to the side edge of the clothing projects out of the edge protector, this thread cannot be pulled out of the edge protector over its entire length, instead only a small piece of the thread breaks off.

It should be noted that the term "film strip" in the sense of the present invention implies that the width of the film strip is considerably smaller than the width of the clothing, the edges of which are to be protected. Furthermore, it should be noted that the term "slight melting" in the sense of the present invention means that the material of the film strip and of the threads in the edge region of the clothing is not fully melted, with the result that the film strip and the threads lose their shape, but that the material is to some extent only softened by the input of energy. In particular in the case of the threads, it is sufficient that these are slightly melted only on the surface. The film material, on the other hand, can be softened approximately over its entire thickness, in order to be able to be pressed into the woven material easily. As a result of the slight melting, pressing in and cooling, the result is thus not only a form-locking connection of film strip and woven material but, additionally, also an integral connection.

In order to obtain a smooth and clean edge on the finished clothing, according to a development of the invention, it is proposed that that side edge of the clothing which is provided with the film strip is then trimmed further. Trimming can be carried out here either conventionally mechanically, for example by means of a so-called "disk cutter", or else with modern technologies, such as, for example, by means of ultrasound technology.

Preferably, not just one of the two side edges of the clothing is provided with an edge protector according to the method steps according to the invention, but both side edges.

In order that the integral connection between the film strip and the threads of the clothing can be formed optimally, provision can be made for the clothing and the film strip to be substantially formed from the same basic material. For example, all the weft threads and/or warp threads of the clothing can be formed from the same material as the film strip.

Good trial results could be achieved with film strips which are predominantly, preferably completely, formed from PET. Here, PET is an abbreviation for the designation polyethylene terephthalate. Furthermore, good trial results could be achieved if the film strip has a width between 20 mm and 50 mm, preferably between 30 mm and 40 mm, and/or the film strip has a thickness between 50 μm and 400 μm, preferably between 100 μm and 350 μm.

Furthermore, it is proposed that that surface of the film strip which faces the clothing and that surface of the clothing which faces the film strip are heated by means of a jet of hot air, wherein the jet of hot air is preferably directed into an inlet gap formed between the film strip and the clothing. By directing the jet of hot air into the inlet gap, it is possible to ensure that, in particular, the film strip is melted slightly only on the side which faces the woven material of the clothing, whereas that surface of the woven material strip which faces away from the woven material can remain largely solid. Thus, the film strip can be pressed into the woven material of the clothing simply by means of a pressing element, without the film strip sticking or adhering to the pressing element.

As an alternative thereto, provision can also be made for that surface of the film strip which faces the clothing and that surface of the clothing which faces the film strip to be heated by means of a heating wedge. The term "heating wedge" is to be understood to mean a substantially wedge-shaped component which can discharge heat, for example by being itself electrically heated. For this purpose, the flanks preferably come into contact with the surfaces to be heated, which are guided over the flanks of the heating wedge and taper toward each other in accordance with the geometry of the heating wedge, in order then to be pressed against one another or pressed into one another.

In a first advantageous variant of the method according to the invention, the pressing force onto the film strip applied to the surface of one of the two side edges of the clothing can be produced by means of a pressure roll, wherein a further roll or further pressure rolls or a substantially flat plate can preferably be used as an opposing element to the pressure roll.

In a second advantageous variant of the method according to the invention, the pressing force onto the film strip applied to the surface of one of the two side edges of the clothing can be applied by means of two pressure plates tapering toward one another in a wedge shape, wherein the clothing, together with the film strip, can be guided through a tapering gap between the two pressure plates.

A further aspect of the present invention relates to a clothing having an edge protector which has been produced by the previously described method according to the invention. In particular in the case of dryer fabrics, an effective edge protector is of great importance in order to prevent premature wear at the edges of the dryer fabrics.

In the following, some advantageous embodiments of the invention will be explained in more detail by using exemplary embodiments, reference being made to the drawings, which are not to scale. The features recited can advantageously be implemented not only in the combination illustrated but can also be combined with one another individually.

DETAILED DESCRIPTION OF THE INVENTION

Figure 1:
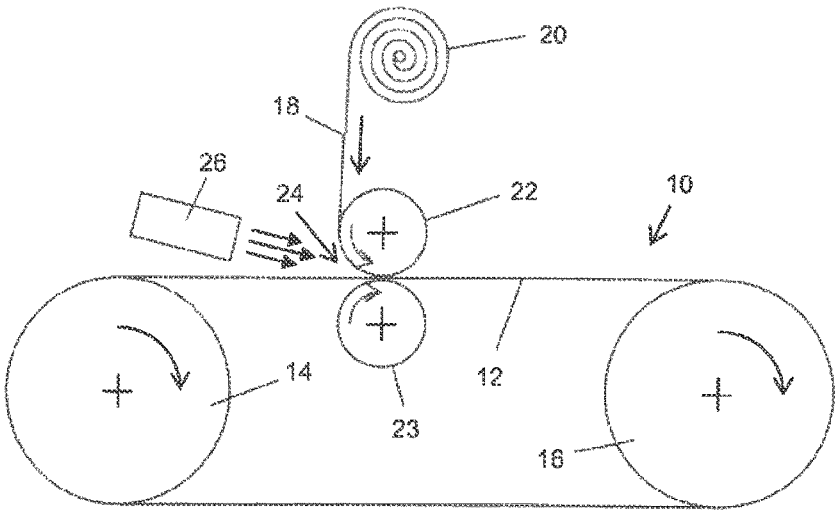
FIG. 1 shows a first exemplary embodiment of the method according to the invention.

In the following, the figures will be described in more detail. FIG. 1 illustrates a first exemplary embodiment of the method according to the invention. To provide a clothing 10, for example a woven dryer fabric, with an edge protector 12, the clothing 10 is firstly stretched over two rotatably mounted rolls, namely a first tensioning roll 14 and a second tensioning roll 16. A film strip 18, which can be wound up on a roll 20, is then applied to one of the two side edges of the clothing 10. For this purpose, the film strip 18 is guided over a pressure roll 22. The pressure roll 22 can be or is positioned here in such a way that, together with an opposing roll 23, it exerts a predefined pressing force on the film strip 18 when the latter is guided together with the clothing 10 through a gap 24 between pressure roll 22 and opposing roll 23. The pressing force on the film strip 18 is dimensioned here such that the film strip 18 substantially completely penetrates the woven material of the clothing 10, so that the threads of the clothing 10 in the region of the side edge are enclosed completely by the film strip 18. In order that the penetration of the woven material by the film strip 18 becomes possible, both the woven material and the film strip 18 are warmed previously, so that they melt slightly. To this end, use is made of a hot air source 26, which is oriented in such a way that a jet of hot air, which is indicated by three parallel arrows in FIG. 1, is directed into the gap 24. Preferably, the amount of heat is calculated such that the threads in the edge region of the woven clothing 10 melt and soften only at the surface, whereas the film strip 18 is softened almost over its entire thickness. The method can be continued continuously until the clothing 10 has been provided with the edge protector 12 along its entire circumference. Subsequently or simultaneously, that edge of the clothing which is opposite in the cross-machine direction can also be provided with an edge protector 12 in the same way.

Figure 2:
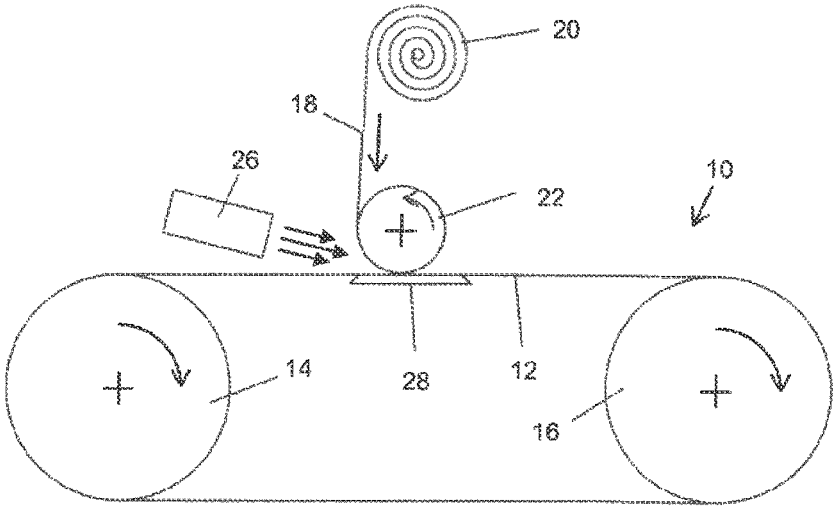
FIG. 2 shows a second exemplary embodiment of the method according to the invention.

FIG. 2 illustrates a second exemplary embodiment of the method according to the invention. The same designations relate here to the same components or component sections as in the embodiment in FIG. 1. To this extent, only the differences from the embodiment in FIG. 1 will be discussed below, and otherwise reference is made to the above description. The essential difference between the first embodiment and the second embodiment consists in the pressure roll 22 not forming a gap 24 in interaction with the opposing roll 23, by which gap a pressing force is exerted on the film strip 18, but instead, such a gap is formed in the interaction of the pressure roll 22 with a plate 28. The plate 28 can be substantially flat, i.e. have a surface which faces the pressure roll 22 and which is substantially flat. The plate 28 preferably has here an inlet slope (at its left-hand end in FIG. 2). The hot air source 26 again has to be positioned such that it directs a jet of hot air into the gap between pressure roll 22 and plate 28.

Figure 3:
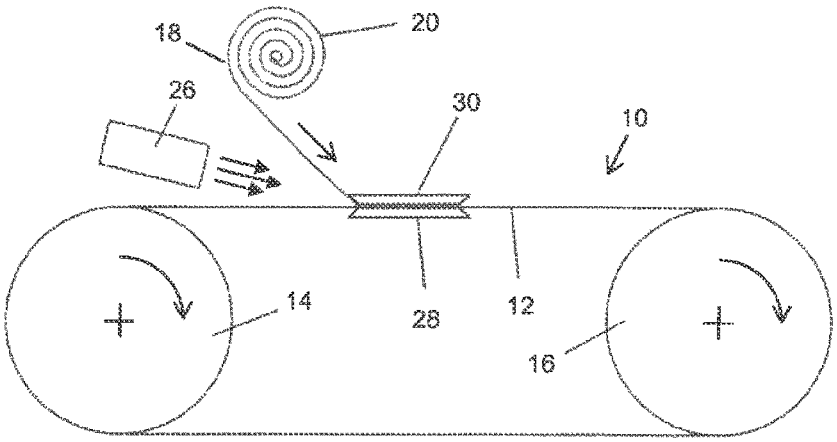
FIG. 3 shows a third exemplary embodiment of the method according to the invention.

FIG. 3 illustrates a third exemplary embodiment of the method according to the invention. The same designations refer here to the same components or component sections as in the embodiment in FIG. 2. To this extent, only the differences from the embodiment in FIG. 2 will be discussed below, and otherwise reference is made to the above description relating to the first two embodiments. The essential difference between the second embodiment and the third embodiment consists in the pressure roll 22 of the second embodiment having been replaced by a further plate 30 which forms a gap in interaction with the plate 30, by which gap a pressing force is exerted on the film strip 18. The two plates 28, 30 together preferably form here a tapering gap, through which the clothing 10 is guided together with the film strip 18, in order that the film strip 18 is pressed through into the woven material of the clothing 10 and preferably penetrates said woven material completely. The hot air source 26 is positioned as in the second embodiment.

Figure 4:
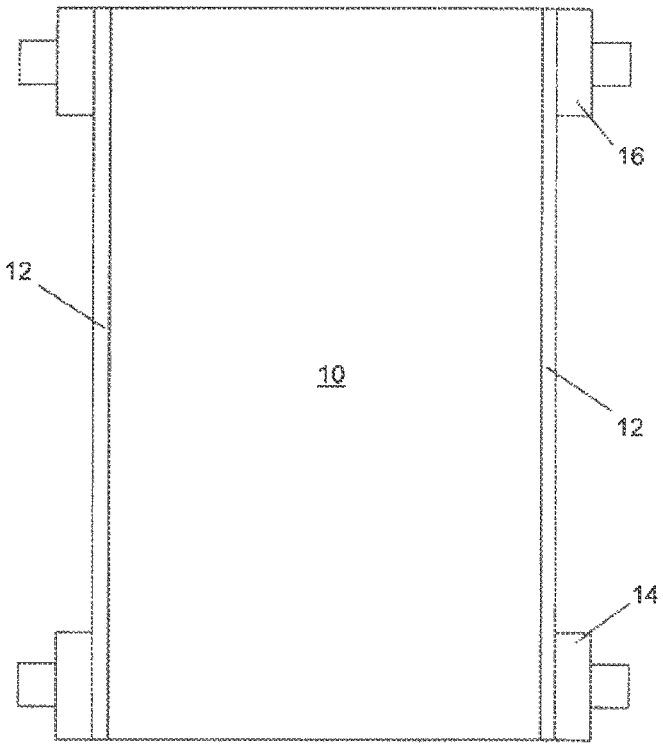
FIG. 4 shows a view from above of the clothing provided with an edge protector.

FIG. 4 shows a plan view of the clothing 10 which is stretched over the two tensioning rolls 14, 16 and which, at its two side edges, is provided with a respective edge protector 12. Preferably, the two side edges are then further trimmed, for example by means of ultrasound technology, in order to obtain smooth edges and a clothing with an accurately defined width. The threads of the woven material are protected so well here by the form-locking and integral connection that it is almost impossible for individual threads to be detached out of the edge protector 12. Rather, individual thread ends which project out of the edge protector 12 under certain circumstances tend to break off.

LIST OF DESIGNATIONS

10 Clothing
12 Edge protector
14 First tensioning roll
16 Second tensioning roll
18 Film strip
20 Roll
22 Pressure roll
23 Opposing roll or further roll
24 (Inlet) gap
26 Hot air source
28 Plate
30 Further plate

The invention claimed is:

1. A method for producing an edge protector on a clothing for a machine for producing or finishing a fibrous, paper, board or tissue web, the method comprising:

providing the clothing to be provided with the edge protector, the clothing being substantially formed from a woven material with crossing weft threads and warp threads and two side edges lying opposite one another;

applying a film strip to a surface of one of the two side edges of the clothing by heating a surface of the film strip facing the clothing and a surface of the clothing facing the film strip, immediately before bringing the film strip into contact with the clothing, to slightly melt the surface of the film strip and the surface of the clothing;

exerting a pressing force on the film strip applied to the surface of one of the two side edges of the clothing, causing the film strip to penetrate at least partially into the woven material; and cooling the side edge of the clothing provided with the film strip, forming a stable connection between the film strip and the side edge of the clothing.

2. The method according to claim 1, which further comprises forming the connection between the film strip and the side edge of the clothing to be integral and form-locking.

3. The method according to claim 1, which further comprises trimming the side edge provided with the film strip.

4. The method according to claim 1, which further comprises also providing a second side edge of the two side edges of the clothing with an edge protector by carrying out the applying, exerting and cooling steps.

5. The method according to claim 1, which further comprises forming the clothing and the film strip from substantially identical basic materials.

6. The method according to claim 1, which further comprises forming the film strip at least predominantly from PET.

7. The method according to claim 1, which further comprises providing the film strip with at least one of a width between 20 mm and 50 mm or a thickness between 50 μm and 400 μm.

8. The method according to claim 1, which further comprises providing the film strip with at least one of a width between 30 mm and 40 mm or a thickness between 100 μm and 350 μm.

9. The method according to claim 1, which further comprises using a jet of hot air to carry out the step of heating the surface of the film strip facing the clothing and the surface of the clothing facing the film strip.

10. The method according to claim 9, which further comprises directing the jet of hot air into an inlet gap formed between the film strip and the clothing.

11. The method according to claim 1, which further comprises using a heating wedge to carry out the step of heating the surface of the film strip facing the clothing and the surface of the clothing facing the film strip.

12. The method according to claim 1, which further comprises carrying out the step of exerting the pressing force onto the film strip applied to the surface of one of the two side edges of the clothing by using a pressure roll and a further roll or a substantially flat plate as an opposing element to the pressure roll.

13. The method according to claim 1, which further comprises carrying out the step of exerting the pressing force onto the film strip applied to the surface of one of the two side edges of the clothing by using two pressure plates tapering toward one another in a wedge shape and guiding the clothing together with the film strip through a tapering gap between the two pressure plates.

14. A clothing, comprising an edge protector produced according to claim 1.

15. The clothing according to claim 14, wherein the clothing is a dryer fabric.

* * * * *